US005617614A

United States Patent [19]

Locatelli et al.

[11] Patent Number: 5,617,614

[45] **Date of Patent: *Apr. 8, 1997**

[54] MACHINE FOR AUTOMATICALLY WITHDRAWING STAPLE FIBRES FROM FIBRE BALES

[75] Inventors: Claudio Locatelli; Mario Mascheretti, both of Brescia, Italy

[73] Assignee: Fratelli Marzoli & C. S.p.A., Bergamo, Italy

[ * ] Notice: The term of this patent shall not extend beyond the expiration date of Pat. No. 5,553,356.

[21] Appl. No.: 499,776

[22] Filed: Jul. 6, 1995

[30] Foreign Application Priority Data

Jul. 14, 1994 [IT] Italy ..... MI94A1475

[51] Int. Cl.[6] ..... D01G 7/04; D01G 7/12

[52] U.S. Cl. ..... 19/80 R

[58] Field of Search ..... 19/80 R, 97.5, 19/145.5, 81, 85

[56] References Cited

U.S. PATENT DOCUMENTS

| | | | |
|---|---|---|---|
| 4,477,944 | 10/1984 | Binder et al. | 19/80 R |
| 4,623,099 | 11/1986 | Vosbien et al. | 19/80 R |
| 4,984,336 | 1/1991 | Hanselmann et al. | 19/80 R |
| 5,090,090 | 2/1992 | Temburg et al. | 19/80 R |
| 5,090,091 | 2/1992 | Temburg et al. | 19/80 R |
| 5,117,534 | 6/1992 | Temburg | 19/80 R |

FOREIGN PATENT DOCUMENTS

| | | | |
|---|---|---|---|
| 0199041 | 3/1986 | European Pat. Off. . | |
| 0358891 | 7/1989 | European Pat. Off. . | |
| 0394856 | 4/1990 | European Pat. Off. . | |
| 2497838 | 1/1981 | France . | |
| 8327082 | 9/1983 | Germany . | |
| 3932281 | 4/1991 | Germany | 19/80 R |
| 290675 | 6/1991 | Germany | 19/80 R |
| 2185759 | 7/1987 | United Kingdom | 19/80 R |
| 2222606 | 3/1990 | United Kingdom | 19/80 R |
| 2236121 | 3/1991 | United Kingdom | 19/80 R |

*Primary Examiner*—Michael A. Neas
*Attorney, Agent, or Firm*—Diller, Ramik & Wight, PC

[57] ABSTRACT

An improved bale opening machine comprising beaters rotating at high speed in the gaps within a grid of shoes which bear on the bales being worked and which extend longitudinally into that region comprising a series of grooved wheels for leading and conveying the fibres into the region of action of the beaters. The conveying wheels also operate in the gaps between said shoes.

7 Claims, 3 Drawing Sheets

MACHINE FOR AUTOMATICALLY WITHDRAWING STAPLE FIBRES FROM FIBRE BALES

BACKGROUND OF THE INVENTION

This invention relates to automatic fibre withdrawal machines or so-called bale opening machines, which are known to represent the first stage in the processing of textile fibres contained in bales with the task of automatically withdrawing fibres from the staple fibre bales and feeding them to subsequent processing.

To better clarify the technical problems confronted by the present invention and their resultant solution, FIGS. 1 and 2 show the operating scheme of a bale opening device of travelling projection type, to which the present invention constitutes an improvement.

DESCRIPTION OF THE PRIOR ART

In accordance with the operation of prior art bale opening machines (See FIGS. 1 and 2), the bales 1 are located side by side on the floor 2 to form a working surface for the bale opening machine, which consists of a tower frame, not shown in the figures, moving horizontally within the plane of FIG. 1 along a longitudinal guide. This frame carries a projecting cutter or beater arm which extends onto the surface of the fibre bales to be opened and comprises the following main members:

- a suction hood 3 which upwardly conveys the fibres withdrawn from the bales 1; in a preferred version of the machine the lower edges of the hood extend downwards into proximity with the bale working surface;
- one or more beaters 4 rotating at high speed and provided with a plurality of teeth 5 which come into contact with the fibres, to withdraw them from the working surface of the aligned bales 1 and present them to the hood 3; in a preferred version of the machine the teeth 5 of the beaters 4 are offset along the axis of rotation of the beater so as to involve a discrete strip of the working surface of the fibre bales 1 to be opened;
- a series of parallel bars 6 which bear on the working surface to form the support on said surface for the entire described projecting arm assembly with its fibre withdrawal members. In this respect the projecting arm is able to move in the vertical direction relative to its support frame, with suitable travel stops. As can be seen from FIG. 2, which represents a plan view of the machine arm, the bars 6 alternate with the rotating members of the beaters 4 and do not interfere with them. In a preferred embodiment of the machine said bars comprise a portion which is not parallel to the direction of movement, so that the entire bearing surface is exposed to the passage of the assembly comprising the bars and the rotating members connected to them. The toothings 5 of the two beaters 4 are hence axially offset, to thus involve substantially the entire bearing surface;
- a pair of rollers 7 rotating in the direction of movement of the arm, they being grooved in the direction of their axis of rotation and positioned external to the ends of the hood 3 and external to the beaters 4. At each reversal of movement the drive for the rollers 7 reverses their direction of rotation. That roller which precedes the beaters rotates towards the hood in order to convey the fibres into the region of action of the beaters 4.

The rollers 7 are carried by the beater arm during its horizontal movement such that they precede and follow the beaters 4 respectively, but can move freely vertically to it while resting under their own weight on the bale working surface, between an upper travel stop and a lower travel stop. They can hence sink to a greater or lesser extent into the fibres according to the consistency of the bales being worked and depending on whether they precede or follow the beaters;

- the entire projecting arm and its members are contained within a framework 8.

The operation of the bale opening machine is described hereinafter in terms of its essential points.

The bales 1 are arranged in a line to form a working surface for the beater arm. The beater arm is able to move vertically relative to the machine frame. During normal machine working, the bars 16 bear on the working surface of the bales 1, pressing on this surface with constant pressure. This pressure is determined on the basis of the density of the bales 1 of material being worked, and can also be adjusted during working depending on the height of the working surface. It can be increased or decreased by suitable ballast or counterweights applied to the arm, or by equivalent pneumatic or hydraulic devices. The consistency of the bales 1 and their resistance to the pressure exerted by the beater arm are very variable. The yieldability of the working surface varies not only on the basis of the type of fibre worked and the bale packaging, but also within the bale itself. Normally the innermost parts of a given fibre bale are less yieldable than the outermost parts.

The bearing effect of the bars 6 which slide horizontally in the manner of shoes on the working surface causes the surface of the fibres concerned to undergo a certain swelling within the space between two adjacent bars, and in which the rotating teeth 5 of the beaters operate with greatest effectiveness. The action of said beaters 4 is adjusted by adjusting the difference in level between the surface on which the bars 6 bear on the fibres and the lowest point on the trajectory of the teeth 5 or, knowing the beater geometry, the level difference between said resting plane and the plane containing the axes of rotation of the beaters 4. This adjustment determines the degree of penetration of the beater teeth 5 into the fibrous material.

By way of non-limiting example this adjustment can be made between two or more levels by a hydraulic control or a stepping motor operating a connecting rod/crank mechanism which causes the level of the bars 6 to rise or fall relative to the axis of rotation of the beaters 4, as schematically indicated in FIG. 1. Having once made this adjustment, the position of the bars 6 relative to the group of beaters 4 is normally not changed during working. During the opening of the bales, and particularly if they contain natural fibres such as cotton or other fibres of vegetable origin, they may be found to contain extraneous matter. According to the current terminology used in this field, such extraneous matter is known as trash to indicate all residual impurities from ginning, such as stalk, leaf and seed fragments, dust to indicate heavy dust consisting mainly of earth, and microfibre to indicate very short broken fibres, plus fragments of straps or other binding or packaging elements or other bodies deriving from previous fibre handling.

The initial opening of the bale arranges the material for cleaning and for discarding impurities, and it is therefore necessary to ensure a regular flow of fibres at controlled speed. For this purpose the suitably profiled hood 3 and deviator members such as the wedge 9 for lead-in between the beaters ensure that the passage sections are dimensioned for a speed sufficient for effective removal of impurities and their subsequent downstream separation by classification.

The beater arm undergoes a series of horizontal to-and-fro travel strokes along the bale working surface until the bales 1 have all been opened and all the fibres have been removed by the hood 3. The operation is then suspended and the bale working surface is restored by positioning a new layer of bales 1 on the floor in place of that which has been consumed.

The technical problem presented by the aforedescribed type of bale opening machine and which the present invention solves is the following. In considering the horizontal to-and-fro movement of the beater arm it will be noted that the two grooved rollers 7 external to the beaters 4 operate under very different conditions. During each arm travel stroke, that roller 7 preceding the beater group is exposed to a bale working surface which on the whole is higher than that to which the roller following the beater group is exposed. The rollers sink to a greater or lesser extent into the working surface according to their weight, limited by the position of their lower travel stop. The rollers are required to perform a useful conveying and working surface equalization action to facilitate introduction of the material below the bars 6. It is however essential that the rollers do not sink too far into the working surface when moving along in front of the beaters both because they create a swelling which hinders the action of the beaters which follow and-because, especially when working bales of little consistency and when approaching the edge of the working surface, they tend to urge the edges of the fibre bales outside the working surface and outside the working range of the beaters instead of conveying them under the beaters.

The typical yieldability of the working surface which causes swelling of the part surrounding a point of applied pressure causes swelling between the preceding roller and the following beater. Changes in the consistency of the bale working surface hence cause considerable changes in the fibre layer encountered by the beaters, leading to their irregular operation. This results in reduced and inconstant production of the bale opening machine, referred to each travel stroke, which can affect the entire processing train situated downstream of the machine. The terminal mixing bales can also fall.

SUMMARY OF THE INVENTION

The object of the present invention is to provide a bale opening machine which is of improved characteristics compared with the aforedescribed machine.

The advantages and characteristics of the improved bale opening machine of the present invention will be more apparent from the description of a typical embodiment thereof shown in FIGS. 3 and 4.

In its essential lines the bale opening machine according to the invention uses the already described operating scheme but with the following improvements.

DESCRIPTION OF THE PREFERRED EMBODIMENTS

The bearing bars are replaced, according to the present invention, by shoes 16 (FIGS. 3 and 4) which extend longitudinally as far as the region comprising the conveying members by which the fibres from the bale working surface are conveyed into the region of action of the beaters, and possibly beyond these members. The surface formed by the shoes 16 is provided with means for adjusting the level difference between it and the axes of the beaters 4.

Again, the function of the conveying rollers located on the two sides of the beaters 4 is now performed, according to the present invention, by a series of wheels 17 in the form of discs toothed or grooved in the direction of their axis of rotation and carried by the shafts 18 to operate in the gaps between the shoes 16. One or more wheels 17 of different axial dimension can be located in each gap between the shoes 16. If the type of operation to be effected advises the use of a plurality of thinner wheels 17 for each gap, these wheels can be arranged with their grooves mutually corresponding or offset.

Figure 1:
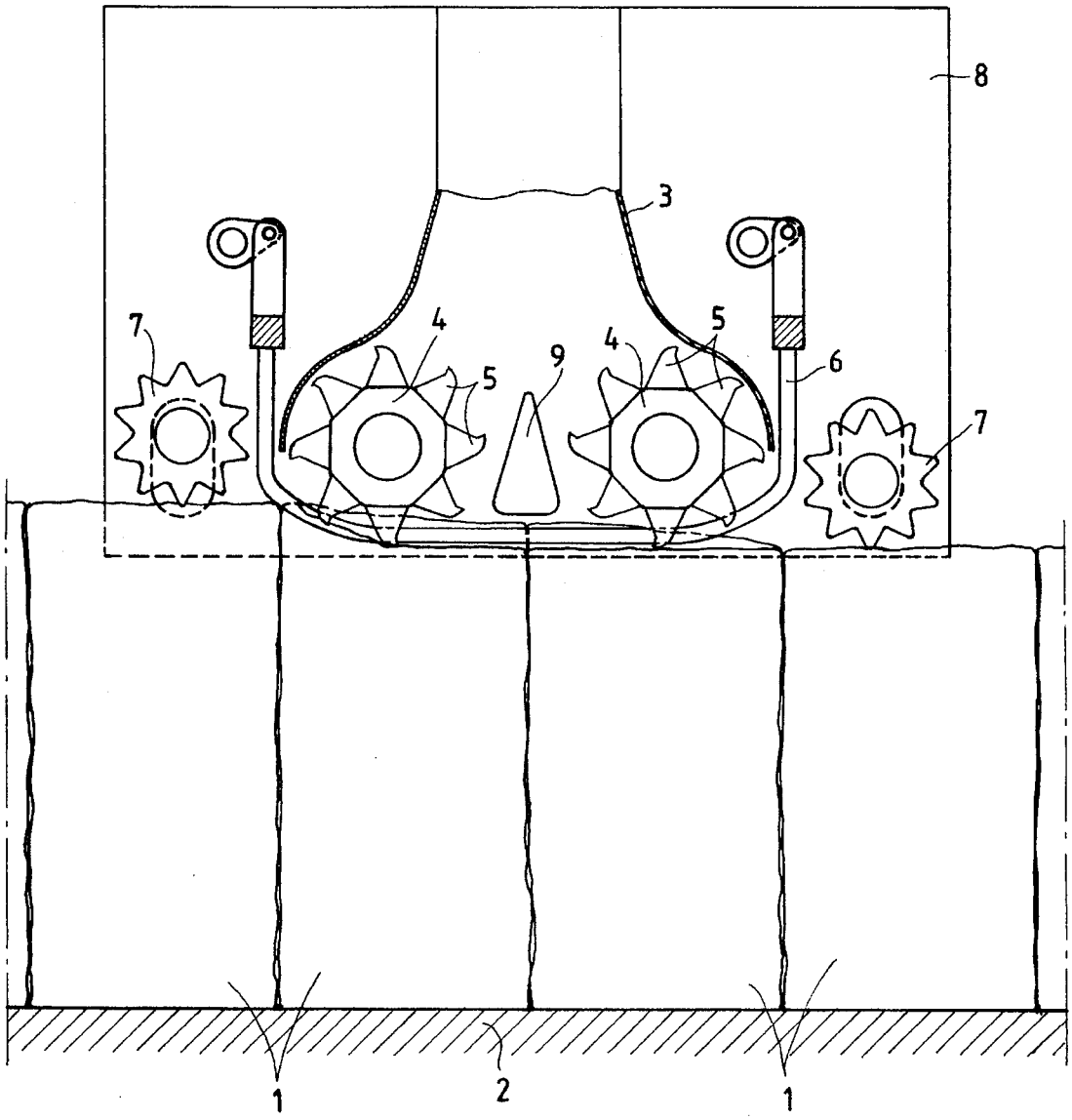
Fig.1 PRIOR ART
FIG. 1 is a longitudinal cross sectional view through a conventional bale opening machine, and illustrates a plurality of bales being operated upon by beaters while being held down by bars and conveyed by rotating members.
Figure 2:
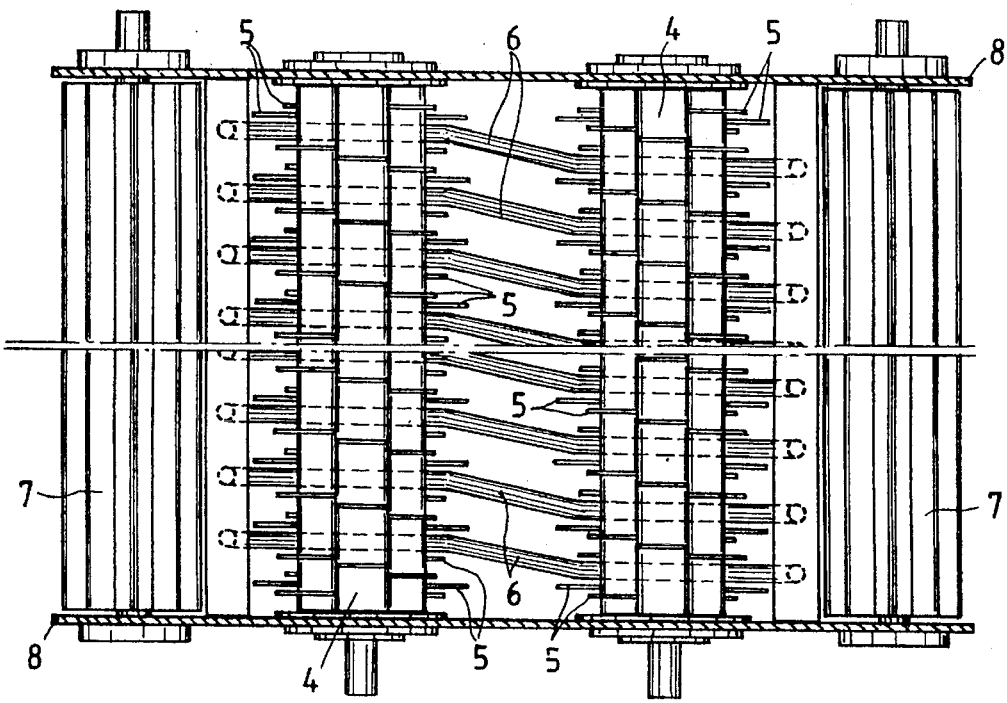
Fig.2 PRIOR ART
FIG. 2 is a longitudinal cross sectional view through the prior art bale opening machine of FIG. 1, and illustrates the relative positions of a plurality of teeth of the beaters and the bars.
Figure 4:
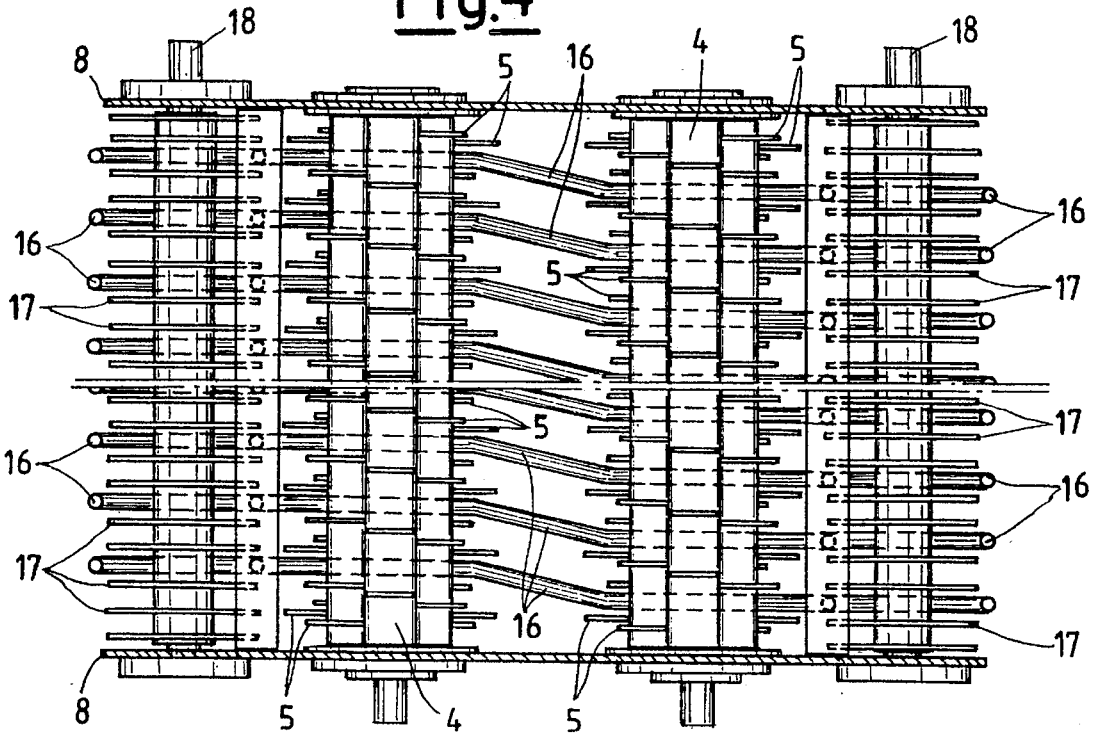
FIG. 4 is a cross sectional view through the bale opening machine of the present invention, and illustrates the relationship of the shoes with respect to teeth of the beaters and conveying wheels.
Figure 3:
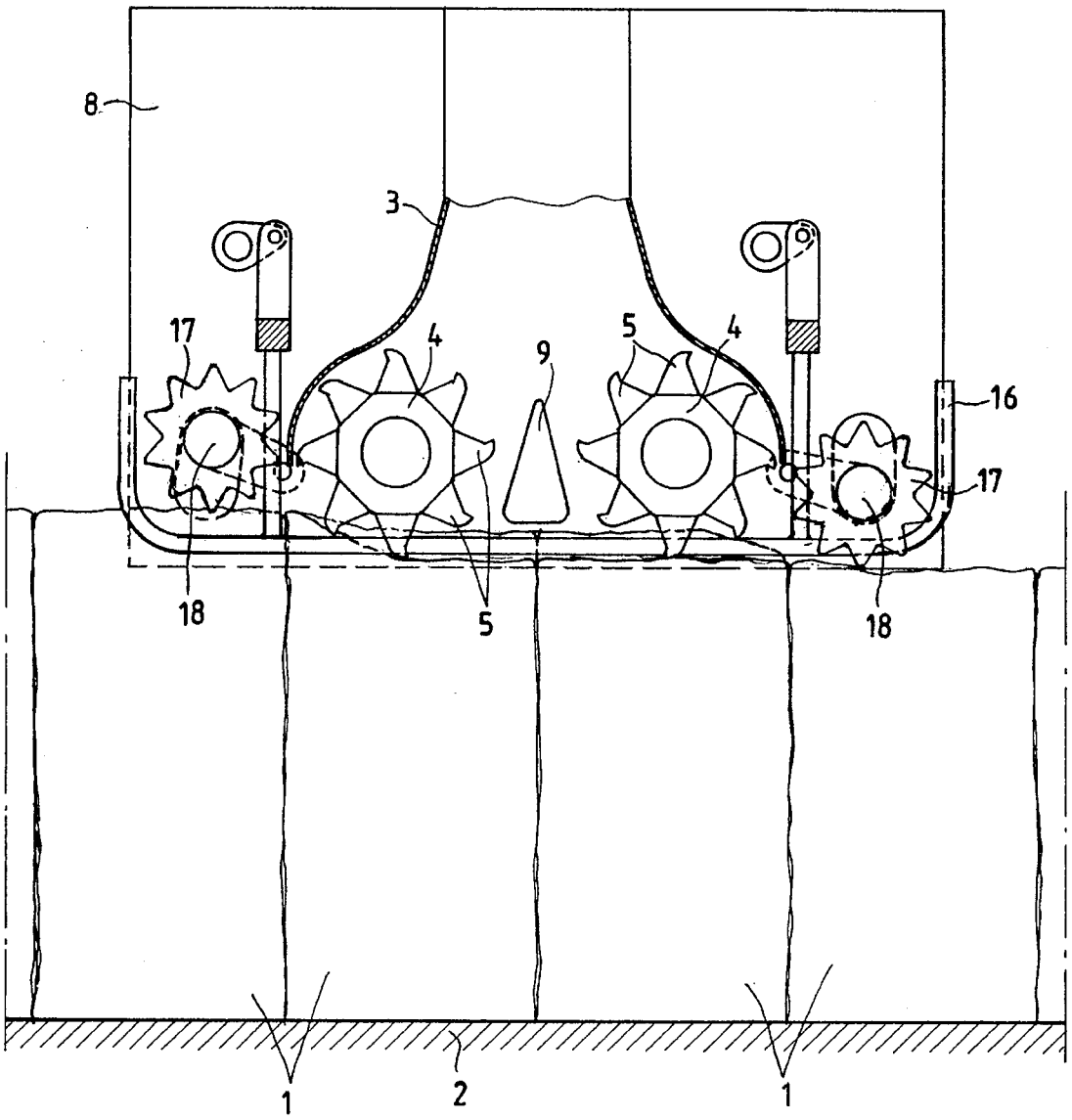
FIG. 3 is a longitudinal side elevational view of a bale opening machine of the present invention, and illustrates shoes replacing the bars of the conventional bale opening machine.

The characteristics and advantages of the bale opening machine according to the present invention will be more apparent from the description of the operation of a typical embodiment thereof given by way of non-limiting example with reference to the schematic representations of FIGS. 3 and 4, of which FIG. 3 is a cross-section through the arm of the machine and FIG. 4 is its plan view.

As can be seen from FIG. 4, which shows a plan view of the arm of the bale opening machine, the shoes 16 are positioned to alternate with the rotating members of the beaters 4 and also with the grooved conveying members 17, and do not interfere with them. The series of wheels 17 positioned on each side of the beater arm can, by the effect of their weight, sink to a greater or lesser extent into the fibres, depending on their consistency and whether they precede or follow the beaters, to an extent controlled by stops. The presence of the shoes totally changes the behaviour of the bale working surface.

The shoes 16 which slide horizontally on the bale working surface now apply the pressure of the beater arm over a larger surface, to give the bale working surface presented to the conveying wheels 17 a greater consistency and regularity. The beaters encounter flattened material rather than accentuated undulations or material of very variable density. At that fibre surface on which the beaters operate, the swelling is of the correct amount in the portion between two adjacent shoes, allowing more effective operation firstly of the projections on the wheels 17 for equalizing and conveying the fibrous material and then of the teeth of the beaters 4 for withdrawing it. Again, the specific pressure with which the wheels 17 bear is much higher than that of the rollers 7, in that the surface area on which they bear their weight is much smaller.

The simultaneous presence of the prolonged shoes 16 and conveying wheels 17 has a double and synergic effect. The shoe pressure accompanying or indeed preceding the wheels 17 prevents the outward thrusting of the edges of the bale working surface, so maintaining these edges under the action firstly of the conveying wheels 17 and then of the beaters 4, with consequent greater utilization of the bales 1.

The pressure of the shoes 16 alternating with the wheels 17 gives rise both to fibre swelling between one shoe and the next leading to greater regularity in the weight of fibre covered by each withdrawal stroke, and to more uniform density of the fibrous material carried under the beaters 4 by the wheels 17, leading to an improved fibre cleaning effect. Overall, the improved bale opening machine shows a significantly greater constancy in the fibre quantity withdrawn for each stroke of the beater arm and a more effective separation of extraneous material.

We claim:

1. An automatic bale opening machine for operating upon a working surface of a fibre bale during fibre bale movement in a predetermined direction comprising a suction hood (3) for upwardly conveying fibres withdrawn from an associated bale (1), at least one beater (4) rotating at high speed, said beater (4) including a plurality of spaced teeth (5) which contact the bale fibres to withdraw the fibres from the bale working surface, a series of parallel bars (16) which bear upon the working surface of the bale, said parallel bars (16) being positioned alternately between said spaced teeth (5), a pair of rotating conveying members (17) positioned externally of the beater (4) and rotating to convey bales to the beater (4), said parallel bars (16) being shoes (16) which extend substantially longitudinally into a region of the pair of rotating conveying members (17), the rotating conveying members (17) including a series of fibre conveying wheels (17) in the form of discs toothed in the direction of rotation and being carried by shafts (18), said shoes (16) having portions disposed in gaps between adjacent toothed discs (17), and the shoes (16) extending longitudinally beyond the fibre conveying wheels (17).

2. The bale opening machine as defined in claim 1 wherein the shoes (16) include a portion generally parallel to the direction of bale movement and opposite end portions transverse thereto, and said opposite end portions are disposed externally of an associated adjacent rotating conveying member (17).

3. The bale opening machine as defined in claim 2 including at least two beaters (4), and each beater (4) having a plurality of spaced teeth (5) which are mutually offset axially whereby substantially the entire working surface of a bale is exposed to and effected by the teeth (5).

4. The bale opening machine as defined in claim 1 wherein means are provided for adjusting the distance between the shoes (16) and the fibre bale working surface.

5. The bale opening machine as defined in claim 1 wherein a single toothed disc (17) is located within each gap between adjacent shoes (16).

6. An automatic bale opening machine for operating upon a working surface of a fibre bale during fibre bale movement in a predetermined direction comprising a suction hood (3) for upwardly conveying fibres withdrawn from an associated bale (1), at least one beater (4) rotating at high speed, said beater (4) including a plurality of spaced teeth (5) which contact the bale fibres to withdraw the fibres from the bale working surface, a series of parallel bars (16) which bear upon the working surface of the bale, said parallel bars (16) being positioned alternately between said spaced teeth (5), a pair of rotating conveying members (17) positioned externally of the beater (4) and rotating to convey bales to the beater (4), said parallel bars (16) being shoes (16) which extend substantially longitudinally into a region of the pair of rotating conveying members (17), the rotating conveying members (17) including a series of fibre conveying wheels (17) in the form of discs toothed in the direction of rotation and being carried by shafts (18), said shoes (16) having portions disposed in gaps between adjacent toothed discs (17), said spaced teeth (5) being free to sink under their own weight a greater or lesser distance into the fibres of an associated bale (1), and means for controlling the sink distance of said spaced teeth (5).

7. An automatic bale opening machine for operating upon a working surface of a fibre bale during fibre bale movement in a predetermined direction comprising a suction hood (3) for upwardly conveying fibres withdrawn from an associated bale (1), at least one beater (4) rotating at high speed, said beater (4) including a plurality of spaced teeth (5) which contact the bale fibres to withdraw the fibres from the bale working surface, a series of parallel bars (16) which bear upon the working surface of the bale, said parallel bars (16) being positioned alternately between said spaced teeth (5), a pair of rotating conveying members (17) positioned externally of the beater (4) and rotating to convey bales to the beater (4), said parallel bars (16) being shoes (16) which extend substantially longitudinally into a region of the pair of rotating conveying members (17), the rotating conveying members (17) including a series of fibre conveying wheels (17) in the form of discs toothed in the direction of rotation and being carried by shafts (18), said shoes (16) having portions disposed in gaps between adjacent toothed discs (17), and several toothed discs (17) are located within each gap between the shoes (16).

* * * * *